United States Patent [19]

Wheeler et al.

[11] Patent Number: 4,856,960

[45] Date of Patent: Aug. 15, 1989

[54] IMPROVED MACHINE FOR LIFTING AND LOADING WEB ROLLS

[75] Inventors: Roger R. Wheeler, Roscoe; John R. Martin, Rockford, both of Ill.

[73] Assignee: Martin Automatic, Inc., Rockford, Ill.

[21] Appl. No.: 193,290

[22] Filed: May 5, 1988

Related U.S. Application Data

[63] Continuation of Ser. No. 910,361, Sep. 22, 1986, abandoned.

[51] Int. Cl.[4] ..... B66C 23/00

[52] U.S. Cl. ..... 414/684; 242/57.1; 242/58.6; 414/910; 414/911

[58] Field of Search ..... 414/684, 910, 911; 242/58.6, 57.1, 79

[56] References Cited

U.S. PATENT DOCUMENTS

| | | | |
|---|---|---|---|
| 3,321,147 | 5/1967 | Martin | 242/58.6 |
| 3,690,583 | 9/1972 | Herman | 242/79 X |
| 3,973,446 | 8/1976 | Vasilantone | 242/57.1 X |
| 4,046,331 | 9/1977 | Decker | 242/58.6 X |
| 4,146,797 | 3/1979 | Nakagawa | 242/57.1 X |
| 4,406,576 | 9/1983 | Inaba et al. | 414/735 |

*Primary Examiner*—Frank E. Werner
*Assistant Examiner*—Donald W. Underwood
*Attorney, Agent, or Firm*—McAndrews, Held & Malloy, Ltd.

[57] ABSTRACT

An improved machine and method for lifting, loading, and maintaining a web roll on a cantelevered spindle so that the web roll may rotate about the longitudinal axis of the spindle thereby permitting the web to be unwound from the web roll. The cantelevered spindle of this machine may be moved, vertically and horizontally, from its normal, unwind position so as to be insertable into the central core opening of the web roll while the web roll is positioned on the floor adjacent to the machine. Thereafter the spindle, and the web roll mounted on the spindle, are moved vertically and horizontally and are returned to the spindle's normal web unwind position. The means utilized to move the spindle horizontally during web roll lifting and loading is also used, in part, to adjust the position of the web roll, during the web unwinding operation, in response to signals from a side-lay sensing device employed to sense the position of the side edge of the web being unwound.

10 Claims, 5 Drawing Sheets

IMPROVED MACHINE FOR LIFTING AND LOADING WEB ROLLS

This application is a continuation of application Ser. No. 910,361, filed Sept. 22, 1986 now abandoned.

BACKGROUND OF THE INVENTION

The present invention relates to machines and methods for lifting, loading and maintaining a web roll on a cantilevered spindle so that the web roll may rotate about the longitudinal axis of the spindle thereby permitting the web to be unwound from the web roll. The web may be a variety of materials, such as paper, foil, film, laminate, two ply pressure sensitive label stock, etc.

Web rolls are relatively heavy and bulky. Conventional web roll unwind machines have had a relatively fixed spindle, in terms of the spindle's vertical and horizontal position vis-a-vis the rest of the unwind machine. In the past, a common method of loading a web roll onto a cantilevered spindle in such web roll unwind machines has been to bring the web roll to the spindle. After the web roll has been positioned on the floor or other fixed surface adjacent to the unwind machine, the web roll most be lifted vertically until its central core opening is aligned with the distal end of the spindle. The web roll must then be moved, horizontally, toward the spindle so that the spindle may be inserted within the central core opening of the web roll. This lifting and loading tends to be somewhat of a time consuming and difficult task that requires the use of means, often independent of the unwind machine, for lifting and moving the web roll.

SUMMARY OF THE INVENTION

In principal aspect, the present invention relates to an improved machine and method for lifting and loading web rolls. In contrast to the heretofore conventional practice, the cantilevered spindle of the improved machine may be moved, vertically and horizontally, from its normal, unwind position so as to be insertable into the central core opening of the web roll while the web roll is positioned on the floor or other fixed surface adjacent to the machine. Thereafter, the spindle, and the web roll mounted on the spindle, are moved, vertically and horizontally, to the spindle's normal unwind position.

The improved machine and method of the present invention provides a commercially important advantages in that no additional means need be employed to lift and load the web roll and in that the lifting and loading operation may be easily and quickly accomplished by a single person. Another significant advantage is that the assemblies used to move the cantilevered spindle horizontally during the web roll lifting and loading operation may also be used to adjust the position of the web roll, and thus the position of the web, during web unwinding in response to signals from a conventional slide-lay web sensing device.

Accordingly, it is an object of the present invention to provide an improved machine for lifting and loading a web roll from an unloaded position, that is, when the web roll is disposed on the floor or other fixed surface, to an unwind position, that is, where the web may be unwound from the web roll by rotation of the web roll about the cantilevered spindle disposed within the central core opening of the web roll. A related object of the present invention is to provide an improved machine, as described, where the spindle is movable, vertically and horizontally, from its normal, unwind position so as to be readily and easily insertable within the central core opening of the web roll, when the web roll is positioned in its unloaded position, and where the spindle, with the roll, may thereafter be returned, by vertical and horizontal movement, to the spindle's normal, unwind position.

Another object of the present invention is to provide an improved machine, as described, where the spindle is mounted on and cantilevered from one end of a lift arm that may be pivoted about its other end and where the lift arm and spindle may be moved horizontally along a path of travel substantially parallel to the longitudinal axis of the spindle. A related object of the present invention is to provide an improved machine, as described, where one end of a power cylinder is pivotally connected with the first end of the lift arm and is used to move the first end vertically and where the other end of the power cylinder is mounted so as to be movable horizontally with the lift arm along the path of travel.

Still another object of the present invention is to provide an improved method for lifting and loading web rolls including the steps of inserting the spindle within the central core opening of the web roll while the web roll is in an unloaded position on the ground or other relatively fixed surface; lifting the spindle, and the web roll off of the fixed surface; moving the spindle and web roll, vertically and horizontally, to an unwind position; and maintaining the spindle and web roll in their unwind position while the web is unwound from the web roll by rotating the web roll on the spindle. A related object is to provide an improved method where the spindle is mounted on and cantilevered from one end of a lift arm that is mounted in a frame; where vertical movement of the spindle results from the pivotal movement of the one end of the lift arm with respect to its other end; and where the horizontal movement of the spindle results from the horizontal movement of the lift arm with respect to the frame.

These and still further objects, advantages and aspects of the present invention are more fully set forth in the detailed description of the preferred embodiment of the present invention which follows.

DESCRIPTION OF THE DRAWINGS

In the detailed description of the preferred embodiment of the invention which follows, reference will be made to the accompanying drawings comprised of the following figues.

DETAILED DESCRIPTION OF THE PREFERRED EMBODIMENT

Figure 9:
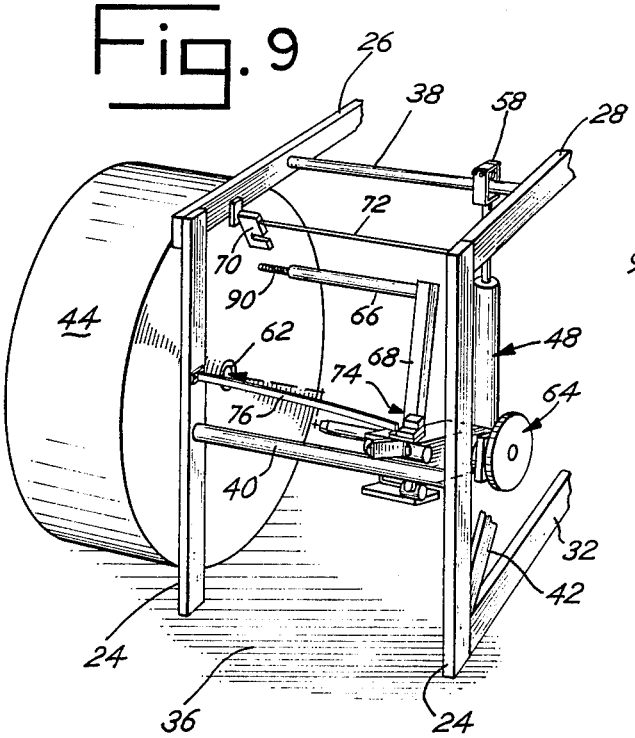
FIGS. 9–12 are partial, end perspective views of the improved machine of FIG. 1 showing various steps of the improved lifting and loading method of the present invention.

Referring now to FIGS. 1–4, two preferred embodiments of the improved machine of the present invention are both generally designated at 20. An open, generally rectangular frame 22 supports these machines, one adjacent to each of the frame's ends. The frame comprises two front and two rear upright corner posts 24. Two horizontal upper frame members 26 and 28 extend between and interconnect the upper ends of the front pair and rear pair of the corner posts 24 respectively. A pair of lower frame members 20 and 32 extend between and interconnect the lower ends of the front pair and rear pair of the corner posts 24 respectively. The lower ends of the corner posts 24 are secured, by means of brackets 34, to the floor or other relatively fixed surface, shown generally at 36 in FIGS. 3, 4 and 9.

A pair of lift arm carriage rods 38 extend between and interconnect the upper frame members 26 and 28. These rods are equispaced about the mid points of the upper frame members, and each is disposed approximately one-third of the way between these mid points and their adjacent corner post 24.

A lift arm guide rod 40 extends between and interconnects each of the front and rear pairs of corner posts 24. Like the rods 38, the lift arm guide rods 40 are disposed so that their longitudinal axes are horizontal. Each rod 40 is connected with its respective pair of corner posts 24 approximately midway between the upper and lower ends of the posts. The rods 38 and 40, together with diagonal truss members 42, extending between the frame members 28 and 32, serve to make the frame 22 rigid and capable of supporting heavy web rolls such as generally shown at 44.

As noted, the frame 22 is designed and intended to support and accomodate with two separate and distinct machines 20. In other words, each of the machines 20 mounted on the frame 22 is capable of lifting and loading a web roll 44, and the frame 22 itself is capable of supporting the two web rolls carried by the two machines. This permits one web roll 44, supported on one of the machines 20, to be unwound while the other machine 20 is being used to lift and load a new web roll to its unwind position. The unwinding of the new web roll can then commence immediately after the one web roll is exhausted so that web can be relatively continuously fed from one or the other of the machines to a web utilizing machine such as a printing press.

Each of the two web roll lifting and loading machines 20 on the frame 22 are identical in structure and function. They are supported on the frame so as to be mirror images of each other about a central, vertical plane that includes the mid points of the frame member 26–32. Consequently in the following description of the preferred embodiment, the same reference numerals will be used to describe the same assemblies, subassemblies and component parts in each of the machines 20, and only one of the machines will be described.

As best shown in FIGS. 1–6, each machine 20 includes a generally rectangular lift arm assembly 46. A lift cylinder assembly 48 is connected, by means of a lift pin 50, with the end 52 of the lift arm assembly 46 adjacent to the above noted central vertical plane of the frame 22. A first bearing assembly 54 is mounted on the opposite end 56 of the lift arm assembly 46 and serves to mount the lift arm assembly on the adjacent lift arm guide rod 40. The cooperation between the first bearing assembly 54 and its associated lift arm guide rod permits the lift arm assembly 46 to pivot about the longitudinal axis of the lift arm guide rod and additionally to be moved along a path of travel parallel to the longitudinal axis of the lift arm guide rod.

The pivotal movement of the lift arm assembly 46 is achieved by actuation of the cylinder assembly 48 which acts to raise and lower the end 52. A second bearing assembly 58 is mounted on the rod end of the lift cylinder assembly and is used to mount the rod end on its associated, adjacent lift arm carriage rod 38. This mounting permits the lift cylinder assembly 48 to pivot about the longitudinal axis of the lift arm guide rod 40 and additionally to be moved along a path of travel parallel to the longitudinal axis of that carriage rod.

A spindle assembly 60 is mounted and projects forwardly, in cantalever fashion, from the end 52 of the lift arm assembly 46. The spindle assembly is designed to be inserted in the central core opening 62 of a web roll 44.

A brake assembly 64 is interconnected with the spindle assembly 60 and is mounted on the assembly 60 and the lift arm assembly 46. This assembly 64 is positioned between the lift arm assembly 46 and a vertical plane including the rear frame members 28 and 32.

An idler roller assembly 66 is mounted on the upper end of a vertical stand 68. The lower end of the stand 68 is welded to the top of the lift arm assembly 46, adjacent to its end 56. The idler roller assembly 66 is generally horizontally disposed. The height of the stand 68 is sufficient that the roller assembly 66 lies above the side of a web roll 44 when that web roll is mounted on the spindle assembly 60, as best shown in respect to the machine 20 on the right hand side of FIG. 1.

A side-lay sensing device 70 is mounted between the upper frame members 26 and 28 by means of a mounting rod 72 that extends between the frame members. As web is unwound from a web roll 44 mounted on the spindle assembly 60, it passes about the idler roller assembly 66 and past the side-lay sensing device 70. In accordance with normal practice, the side-lay sensing device 70 senses the position of a side edge of the web, with respect to a preselected reference point, as the web passes the device 70. The side-lay sensing device then provides feedback signals that reflect the position of the side edge of the web with respect to this reference point.

Figure 4:
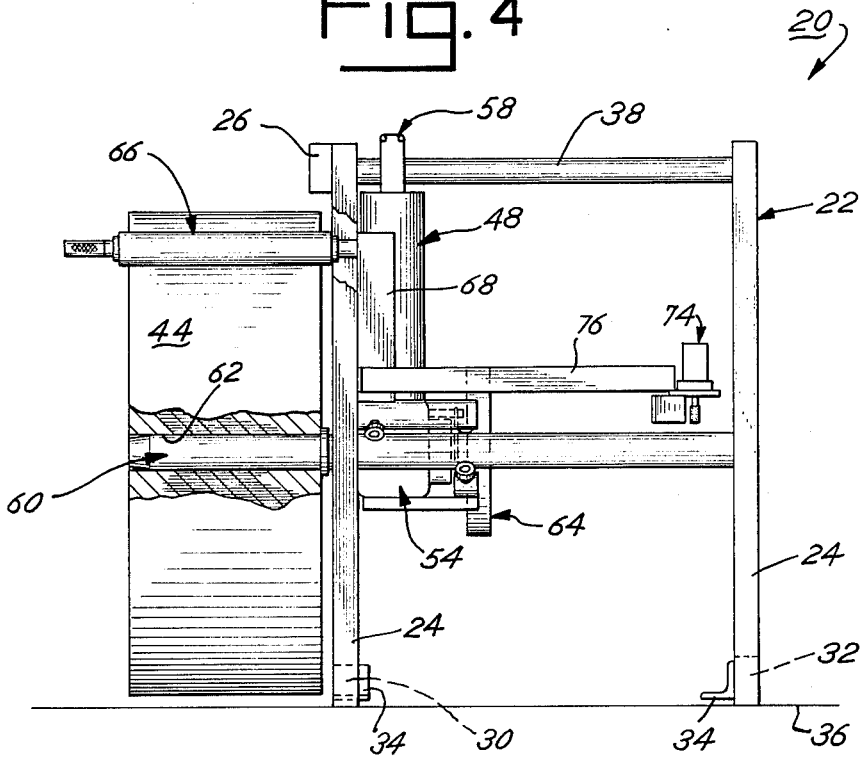
FIG. 4 is a partial, end elevational view, similar to that of FIG. 3, with the spindle being shown inserted in the central core opening of the web roll and with the spindle and web roll being shown raised or lifted upwardly from its unloaded position.
Figure 8:
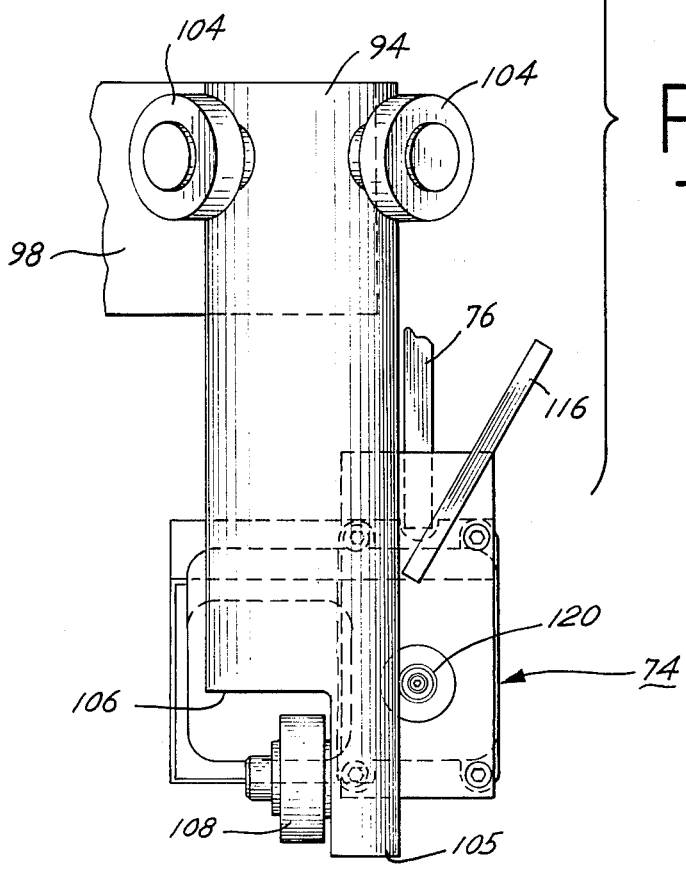
FIG. 8 is a view taken along the line 8—8 in FIG. 7 and also includes an illustration showing the end mounting for the spring member which carries the side-lay motor assembly.

A side-lay motor assembly 74 is mounted on one end of a flat, elongated spring member 76 and is disposed above the lift arm guide rod 40. The other end of the spring member 76 is mounted, as best shown in FIGS. 2, 4 and 8, to the rear facing surface of the front corner post by means of a mounting pad 78. When the web roll 44 is not in its unwind position, such as shown in FIGS. 4, 9, 10 and 11, the longitudinal axis of the flat spring member 76 is straight and is parallel to the longitudinal axis of its associated lift arm guide rod 40. As hereinafter described in more detail, when the web roll 44 is in its unwind position, such as shown in FIGS. 1, 2, 3 and 12, the spring member 76 permits the side-lay motor assembly 74 to be deflected, or moved horizontally away from the lift arm assembly 46, although the assembly 74 is then still contacts the first bearing assembly 54.

Figure 5:
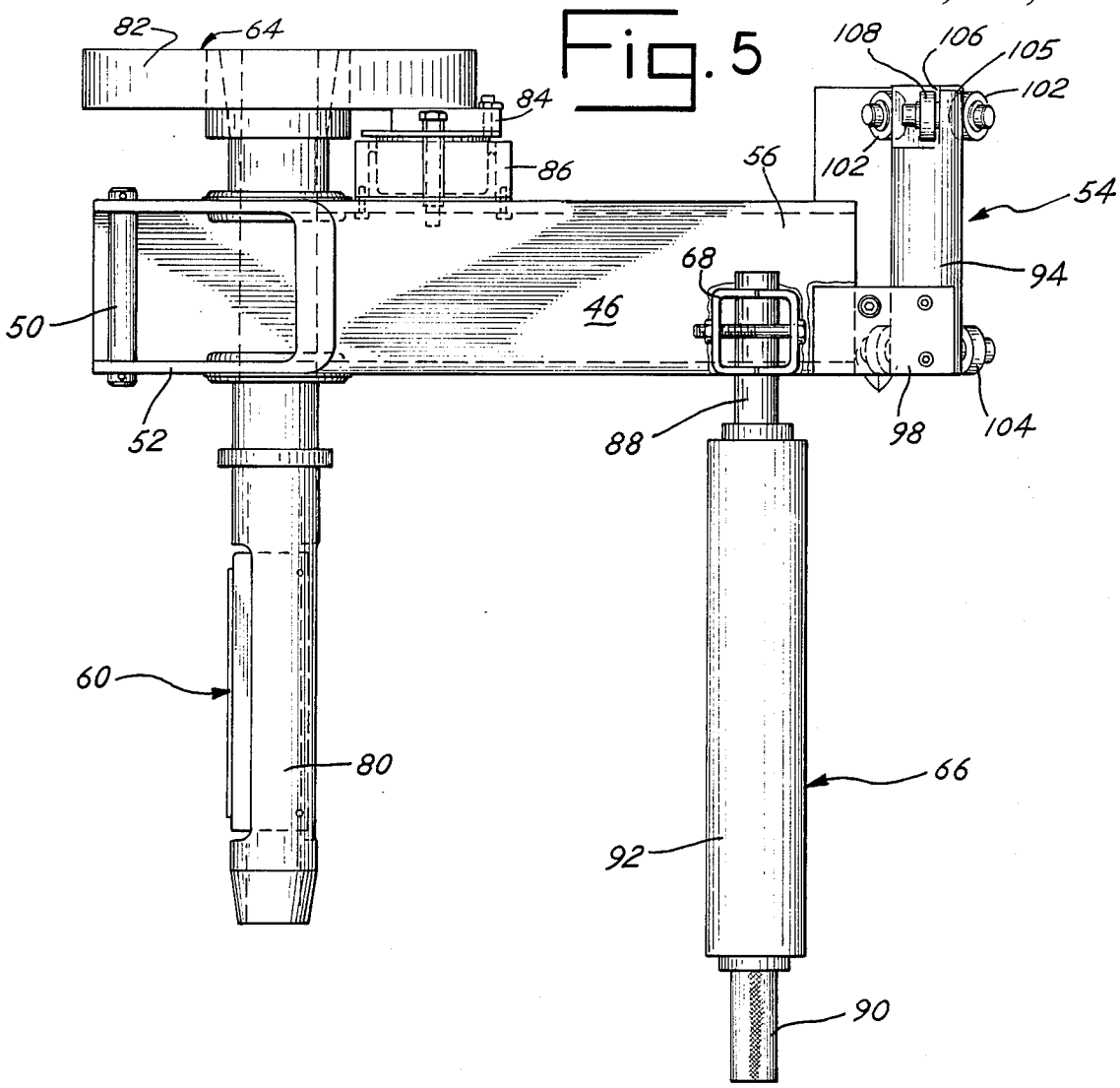
FIG. 5 is a partial, top elevational view of the lift arm assembly, spindle assembly, brake assembly, idler roller assembly, and first bearing assembly.
Figure 6:
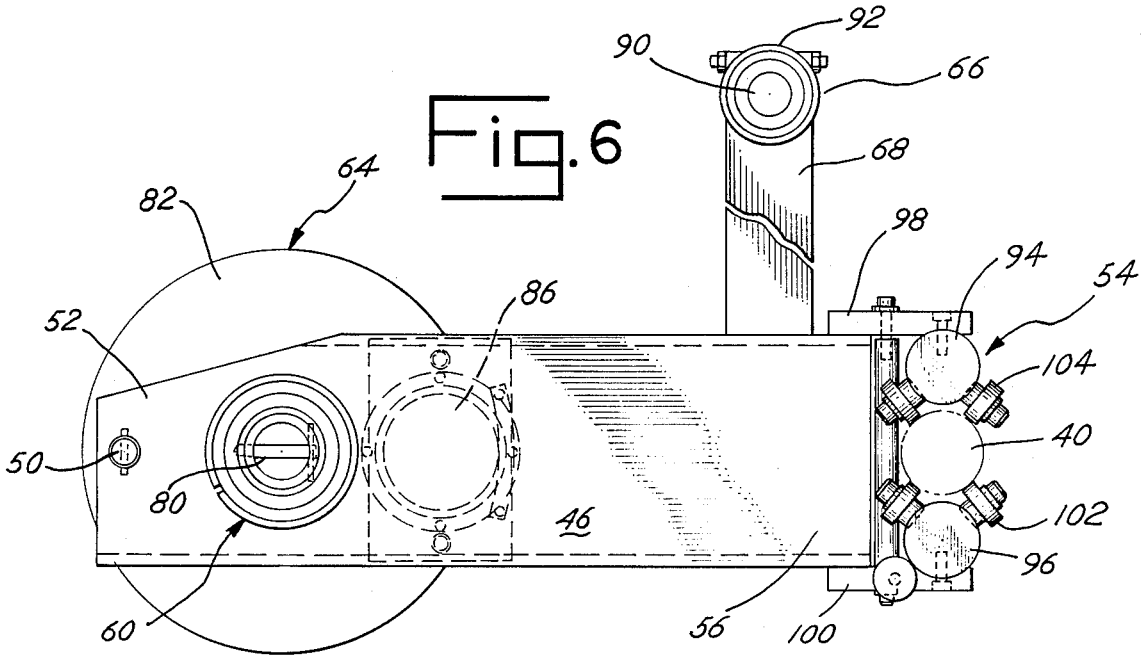
FIG. 6 is a partial, front elevational view of the assemblies of FIG. 5.

The arm of the lift arm assembly 46 is made of four flat plates that are welded together, along their edges, to form a rectangular tube. Obviously the arm could also be a purchased rectangular tube. As best illustrated in FIGS. 5 and 6, the upper part of the end 52 is cut away so as to receive the lower end of the lift cylinder assembly 48 which as noted, is pivotally connected to the lift arm assembly by the horizontally disposed lift pin 50.

The spindle assembly 60 includes a cantilevered core end 80 adapted to be inserted within the central core opening 62. The distal end of the core end 80 is tapered to facilitate such insertion. The core end 80 may include a core chuck subassembly, such as disclosed in U.S. Pat. Nos. 4,143,829 and 4,531,683. The longitudinal axis of the core end 80 is perpendicular to the longitudinal axis of the arm of the lift arm assembly 46, and as discussed above, is also substantially parallel to the longitudinal axis of its associated lift arm guide rod 40.

The brake assembly 64 includes a brake disc 82 mounted on the connected with the spindle assembly 60. A brake pad 84 and a brake cylinder 86 are mounted on the lift arm assembly 46 between that assembly and the front face of the brake disc 82. The brake assembly operates in a conventional manner and its components are of conventional construction. Basically, actuation of the brake cylinder 86 causes the brake pad 84 to be moved against the front face of the brake disc 82 thereby braking and stopping the rotation of the spindle assembly 60.

The idler roller assembly 66 includes a central shaft 88. One end of this shaft is connected with the upper end of the stand 68. This central shaft projects forwardly and horizontally from the stand 68. Its other, distal end 90 forms a handle which may be grasped by a machine operator to assist in moving the lift arm assembly 46 forwardly and rearwardly along its horizontal path of travel parallel to the longitudinal axis of the associated lift arm and guide rod 40. A roller 92 is mounted on the central shaft 88, between its ends, so that the roller may freely rotate about the longitudinal axis of the central shaft 88. The roller 92 serves as an idler roller and determines the direction of the path of travel of the web as it is unwound from a web roll 44 mounted on a spindle assembly 60.

As noted, the first bearing assembly 54 is mounted on the end 56 of the lift arm assembly 46. The assembly 54 includes upper and lower wheel posts 94 and 96 whose lengths are relatively short, as compared to the length of their associated lift arm guide rod 40. The posts 94 and 96 are mounted on upper and lower support pads 98 and 100, respectively, so that their longitudinal axes are parallel with the longitudinal axis of the associated rod 40. The support pads 98 and 100 are secured, adjacent to the end 56, to the top and bottom, respectively, of the arm of the lift arm assembly 46.

The lower wheel post 96 has two pairs of bearings 102, with the pairs being spaced from each other along the longitudinal axis of the post 96. The bearings are arranged so that their bearing surfaces are in contact with and ride on the cylindrical surface of the rod 40.

A pair of bearings 104, similar to the bearing pairs 102, are mounted on the forward end of the upper wheel post 94. Like bearings 102, the bearings 104 are in contact with and ride on the cylindrical surface of the rod 40. The rear end 105 of the upper wheel post 94 is cut away, as generally indicated at 106, adjacent to the lift arm assembly 46. A single bearing 108 is mounted in this cut away portion 106 and is arranged so its bearing surface is in contact with and rides on the cylindrical surface of the rod 40. The bearing 108 is similar in construction to the bearings 102 and 104.

The bearings 102, 104 and 108 support the wheel posts 94 and 96, and thus the lift arm assembly 46, on the lift arm guide rod 40. These bearings permit the lift arm assembly to pivot about its end 56, or more precisely about the first bearing assembly 54, and also permit the assembly 46 to be moved along a path of travel, parallel to the longitudinal axis of the guide rod 40, between the front and rear corner posts 24.

Figure 7:
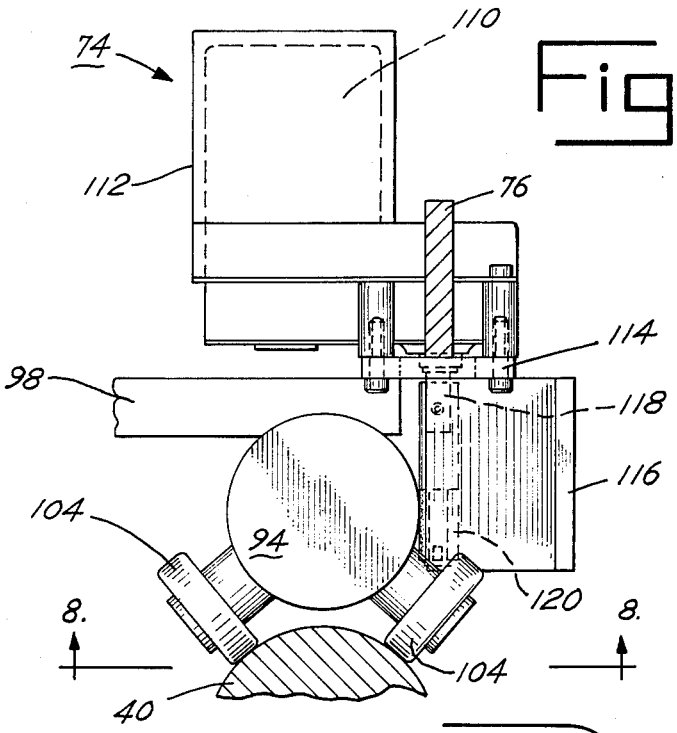
FIG. 7 is a partial, cross-sectional view of a portion of the first bearing assembly and the side-lay motor assembly taken along the line 7—7 in FIG. 3.

Referring new to FIGS. 6, 7 and 8, the side-lay motor assembly 74 includes a conventional motor 110 encased in a motor housing 112. Both are supported on a motor mounting plate 114. The upper surface of the mounting plate 114 is secured to the rearward end of the flat spring member 76 so that the entire assembly 74 is carried by the member 76. A deflection ramp or plate 116 is secured to the lower surface of the mounting plate 114. This deflection ramp is disposed at an acute angle with respect to the longitudinal axis of the wheel post 94, with its distal end being closer to the front and farther away from the assembly 46 than its other end.

Immediately rearwardly of the left hand end, as viewed in FIG. 8, of the deflection ramp 116 is the output shaft 118 of the motor 110. This output shaft is vertically disposed and rotates in either a clockwise or counter-clockwise direction depending on the actuation of the motor 110. A friction sleeve 120, made of a polyurethane material, is secured to the distal end of the output shaft 118 and rotates with the output shaft 118.

As noted above, the side-lay motor assembly 74 is normally positioned over its associate lift arm guide rod 40. However, as the lift arm assembly 46 is moved from a position adjacent the front of the frame 22 to its unwind position, adjacent the rear of the frame, the rearward end 105 of the wheel post 94 contacts the deflection ramp 116 and deflects or moves the assembly 74 to the right as shown in FIG. 8 (that is, away from the end 56 of the lift arm assembly 46). Continued rearward movement of the assembly 46 causes the end 105 to continue to deflect the assembly 74 until the end 105 reaches and passes the left hand end, as shown in FIG. 8, of the ramp 116. Thereafter, no further deflection or movement of the assembly 74 occurs.

As a result of this deflection, the outer periphery of the frictional sleeve 120 closely abuts the cylindrical surface of the wheel post 94 while the arm assembly 46 is in its unwind position. When thus situated, rotation of the output shaft 118, and thus the sleeve 120, causes small incremental forward or rearward additional movement of the wheel post 94 along the rod 40. This rotation is in response to actuation of the motor 110 caused by feedback signals from the side-lay sensing device 74 which, as noted above, senses the position of the side edge of the web, with respect to a preselected reference point, as the web is being unwound from the web roll 44. This additional movement of the wheel post 94 results in corresponding movement of the lift arm assembly 46 and thus the web roll mounted on the spindle assembly 60. In summary, the side-lay motor assembly 74, working in cooperation with the first bearing assembly 54, serves to adjust and correct the position of the web as it is being unwound from the web roll 44 in response to signals from the side-lay sensing device 70.

Figure 1:
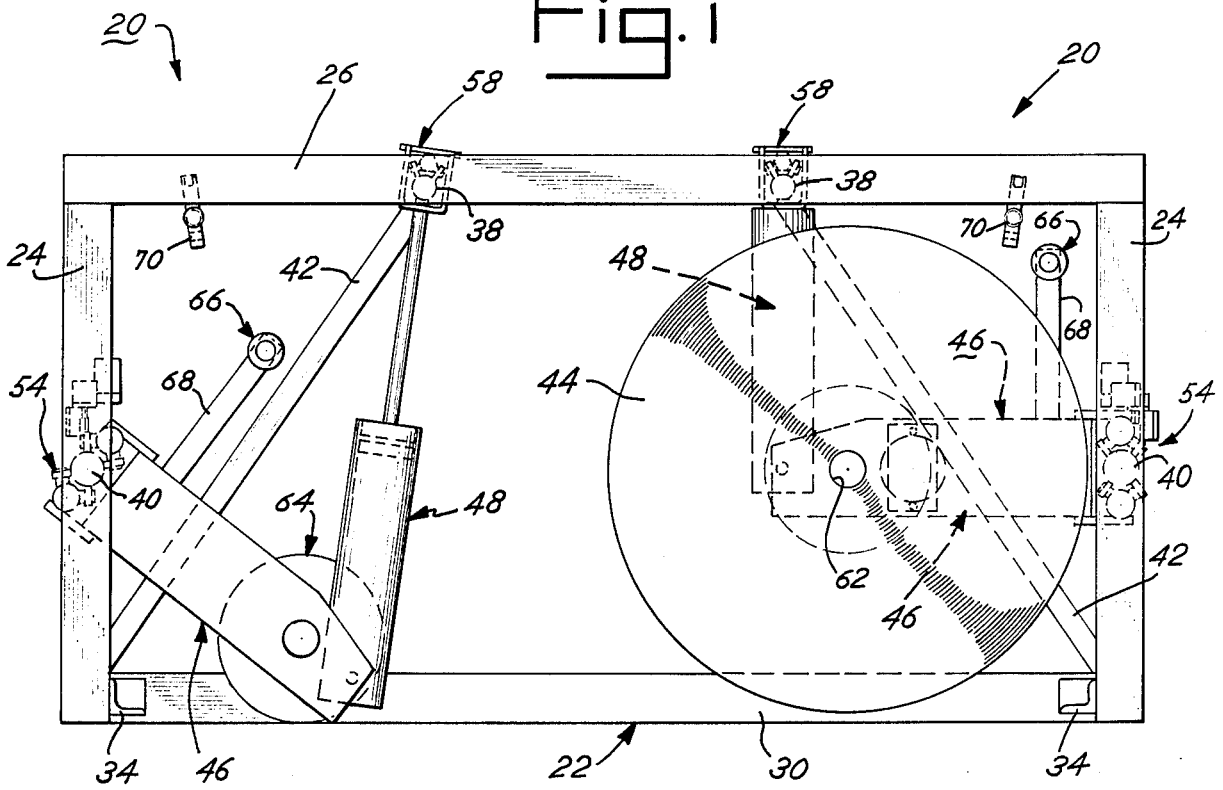
FIG. 1 is a partial, front elevational view of the preferred embodiment of the improved machine of the present invention.
Figure 2:
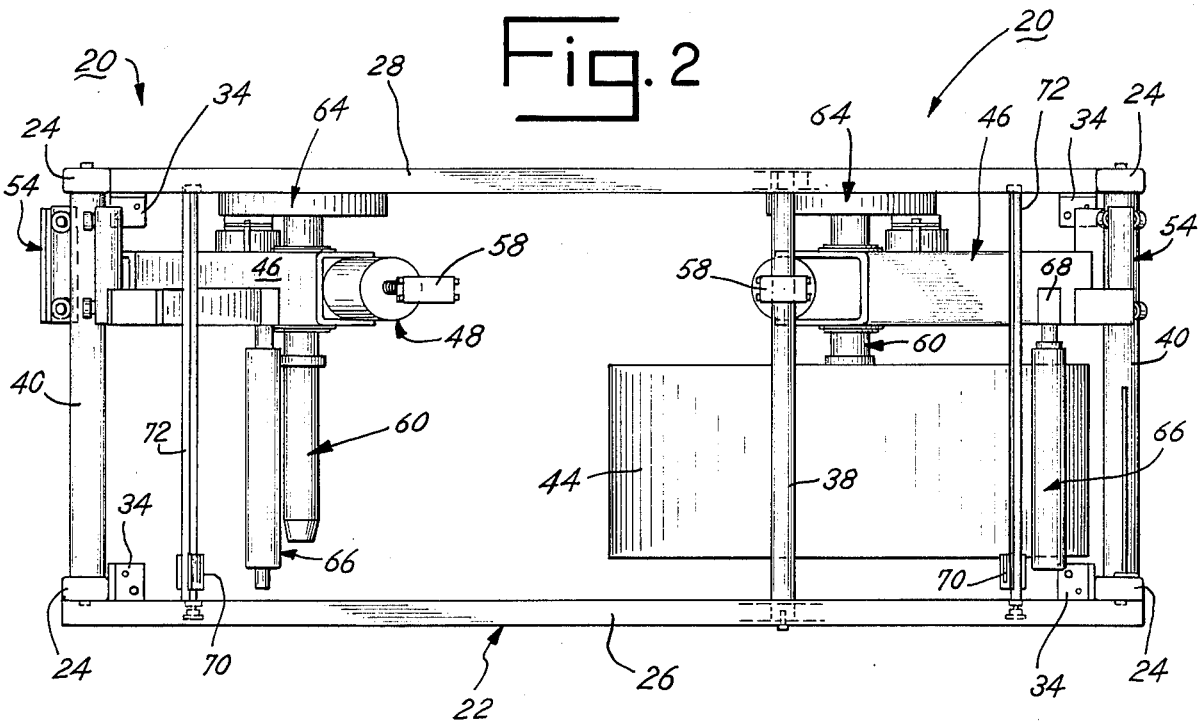
FIG. 2 is a partial, top elevational view of the improved machine of FIGURE 1.
Figure 3:
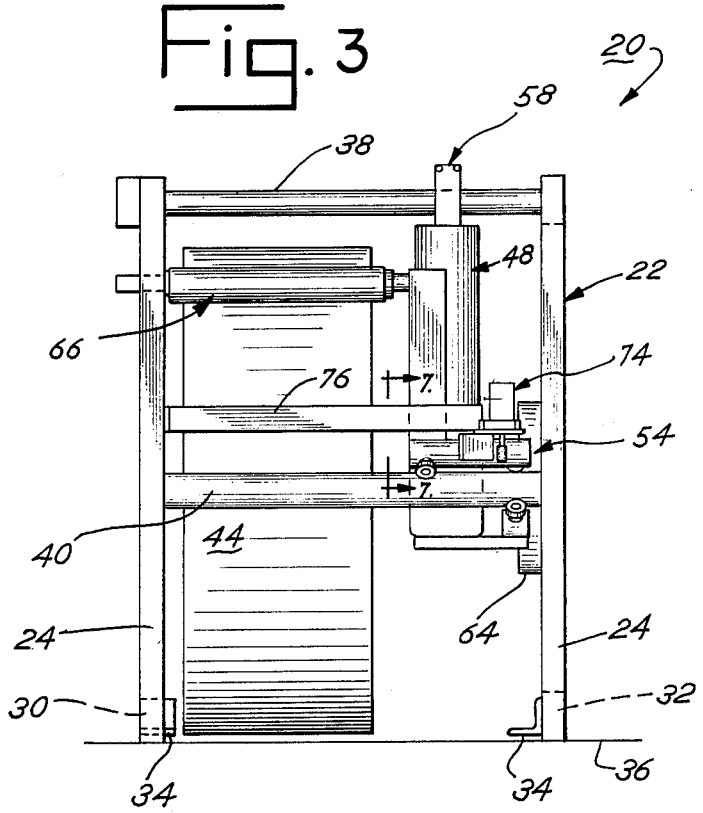
FIG. 3 is a partial, end elevational view of the right hand end, as seen in FIGS. 1 and 2, of the improved machine of FIG. 1, with the web roll being shown in its unwind position.

The second bearing assembly 58 includes a yoke, as best seem in FIG. 1. This yoke is secured to the rod end of the conventional power cylinder of the lift cylinder assembly 48. The upper end of the yoke carries a pair of bearing 124, similar in structure to the bearings 102, 104 and 108. The bearing surfaces of these bearings 124 contact and ride on the upper cylindrical surface of the lift arm carriage rod 38. Hence and as noted, the second bearing assembly 58 supports the assembly 48, and thus the end of end 52 of the lift arm assembly 46. The assembly 58 also permits pivotal movement of the assembly 48 about the longitudinal axis of the rod 38 as well as permitting the assembly 48 to be moved along a path of travel substantially parallel to the longitudinal axis of the rod 38 which as noted above, is parallel to the longitudinal axis of the rod 40.

Figure 10:
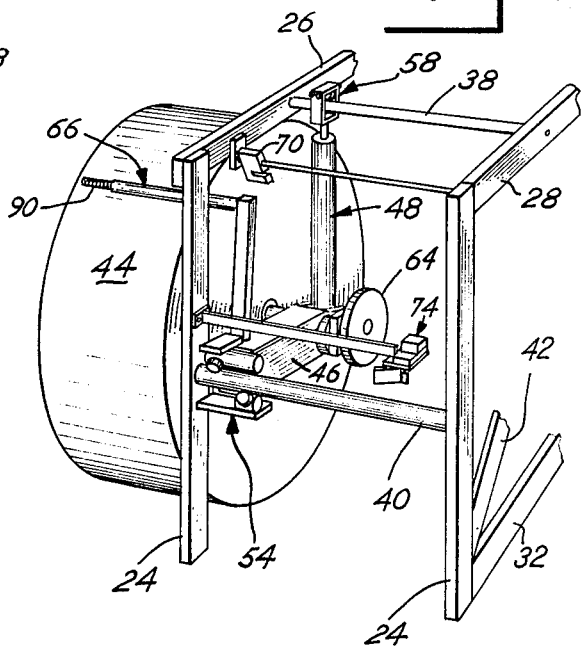
Figure 11:
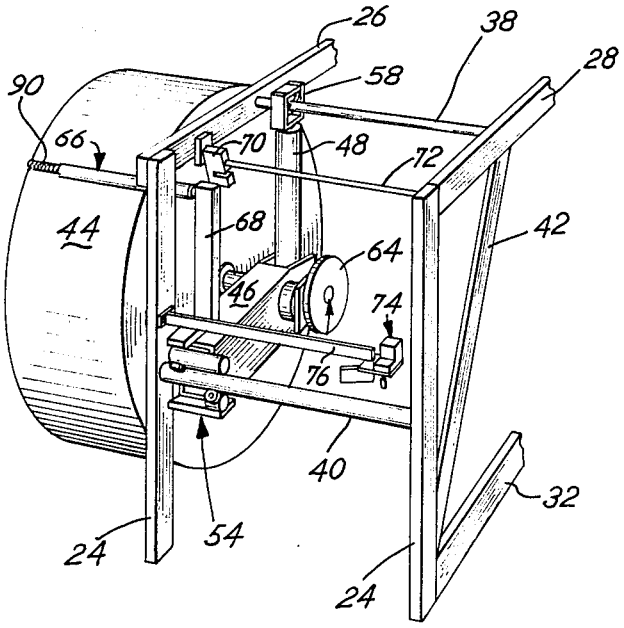
Figure 12:
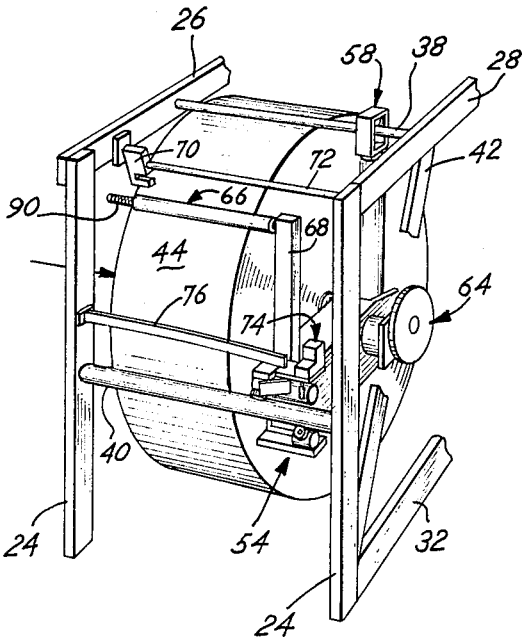

Various steps of the improved method of the present invention are illustrated in FIGS. 9-12. More specifically, a new web roll 44 is positioned on its side on the floor or other fixed surface 36 so that the longitudinal axis of its central core opening 62 is substantially parallel with the longitudinal axis of the spindle assembly 60. The operator then actuates a switch, not shown, which causes the cylinder assembly 48 to lower the end 52 of the arm assembly 46 until the height of the spindle assembly is approximately equal to the height of the central core opening 62. The operator then grasps the handle 90 of the idler roller assembly 66 and pulls the lift arm assembly 46 forwardly along its path of travel which as noted is parallel to the longitudinal axis of its associated lift arm guide rod 40. As the distal end of the core end 80 approaches the core opening 62, the height of the spindle assembly and the position of the web roll may be adjusted by the operator so that the distal end of the core end 80 is aligned with and can be inserted into the central core opening 62 as shown in FIG. 10. After the core end 80 has been inserted into the central core opening 62, the operator then actuates the switch so as to causes the cylinder assembly 48 to retract and raise the lift arm assembly 46, and thus the web roll 44, vertically off the floor 36, as shown best in FIGS. 1 and 11. Thereafter, the operator, grasping the handle 90, may push the assembly 46 and thus the web roll 44 rearwardly until the assembly 46 is adjacent the rear of the frame 22. Before or after this rearward movement, the assembly 48 may be actuated so as to raise the lift arm assembly to a position where the longitudinal axis of the assembly 46 is substantially horizontal. When this vertical and horizontal movement has been completed, the web roll is in its unwind position.

As stated above, the rearward movement of the assembly 46 causes the end 105 of the wheel post 94 to contact the deflection ramp 114 and to deflect, against the bias of the member 76, the side-lay motor assembly 74 out of the way of end 105. This deflection helps to assure that the friction sleeve 120 is brought into close contact with the side of the wheel post 94 while protecting the sleeve 120 from direct contact with the end 105. Thereafter, the operator leads the leading edge of the web on the web roll 44 about the idler roller 92, through the side-lay sensor device 70 and to a printing press or alternatively to the same pre-press device, such as a butt splicer machine. The web then is ready to be unwound. As the web is unwound, the sensor device 70 correctly positions the web by actuating the motor 110 which is noted, serves to re-position the web roll horizontally with respect to the device 70.

The preferred embodiment of the present invention has now been described. This preferred embodiment constitutes the best mode contemplated by the inventors for carrying out their invention. Because their invention may be copied without copying the precise details of the preferred embodiment, the following claims particularly point out and distinctly claim the subject matter which the inventors regarded their invention and which they wish to protect.

We claim:

1. An improved machine for lifting and loading a web roll, that has substantially parallel ends and a central core opening extending from one end to the other, from an unloaded position, where the web roll is disposed on a relatively fixed surface adjacent to the machine and is spaced forwardly of the machine in a first predetermined direction and where the longitudinal axis of the central core opening is substantially parallel to the first predetermined direction, to an unwind position, where the web from the web roll may be unwound by rotation of the web roll about the longitudinal axis of its central core opening and where the web roll is rearwardly of its unloaded position, the improved lifting and loading machine comprising:

a frame for supporting the web roll in its unwind position;

a lift arm having a first end and a second end;

a spindle that is mounted on and cantilevered from the first end of the lift arm, with the longitudinal axis of the spindle being substantially perpendicular to the plane of the lift arm and extending in the first predetermined direction and toward the one end of the web roll when the web roll is in its unloaded position and that is adapted to be received within the central core opening of the web roll;

means for mounting the lift arm on the frame, the mounting means including a first rod that is mounted on the frame so that its longitudinal axis is substantially parallel to the longitudinal axis of the spindle and first bearing means that are mounted on the second end of the lift arm and that engage the first rod whereby the first end of the lift arm may be selectively pivoted vertically, with respect to its second end about a first axis substantially parallel to the longitudinal axis of the spindle and whereby the lift arm may be moved forwardly and rearwardly along a horizontal path of travel substantially parallel to the longitudinal axis of the spindle; and means for moving the first end of the lift arm vertically between an upper position where the web roll, when mounted on the spindle, may be rotated about the longitudinal axis of its central core opening so that the web on the web roll may be unwound from the web roll and a lower position where the spindle may be inserted into the central core opening of the web roll when the web roll is in its unloaded position, the means for moving the lift arm vertically including a power cylinder that has its one end pivotably connected with the first end of the lift arm and that has its other end pivotably connected with the frame; a second rod that is mounted on the frame so that the longitudinal axis of the second rod is substantially parallel to the horizontal path of travel; and second bearing means that are connected with the other end of the power cylinder and engage the second rod so that the other end of the power cylinder may be moved along the longitudinal axis of the second rod and may be pivoted about the longitudinal axis of the second rod; and means for moving the lift arm along the horizontal path of travel forwardly and rearwardly in a direction substantially parallel to the first predetermined direction between a forward position, where the spindle may be inserted in the central core opening of the web roll when the web roll is in its unloaded position, and a rearward position, with the moving means being adapted to selectively move the web roll between its unloaded position and its unwind position.

2. An improved machine for lifting and loading a web roll, that has substantially parallel ends and a central core opening extending from one end to the other, from an unloaded position, where the web roll is disposed on a relatively fixed surface adjacent to the machine and is spaced from the machine in a first predetermined direction, to an unwind position, where the web from the web roll may be unwound by rotation of the web roll about the longitudinal axis of its central core opening, the improved lifting and loading machine comprising:

a frame for supporting the web roll in its unwind position;

a lift arm having a first end and a second end;

a spindle that is mounted on and cantilevered from the first end of the lift arm, with the longitudinal axis of the spindle being substantially perpendicular to the plane of the lift arm and extending in the first predetermined direction and toward the one end of the web roll when the web roll is in its unloaded position, and that is adapted to be received within the central core opening of the web roll;

means for mounting the lift arm on the frame so that the first end of the lift arm may be selectively pivoted, with respect to its second end, about a first axis that is substantially parallel to the longitudinal axis of the spindle and so that the lift arm may be moved along a path of travel that is substantially parallel to the longitudinal axis of the spindle, with the mounting means including: a first rod that is mounted on the frame so that its longitudinal axis is co-axial with the first axis and is substantially parallel to the path of travel of the lift arm; and first bearing means connected with the second end of the lift arm and engaging the first rod so that the second end of the lift arm may be moved along the first rod and so that the first end of the lift arm may be pivoted about the longitudinal axis of the first rod;

means for moving the lift arm between a first position where the web roll, mounted on the spindle, is in its unwind position and a second position where the spindle is inserted into the central core opening of the web roll when the web roll is in its unloaded position; and side-lay sensing means, mounted on the frame, for sensing the position of a side edge of the web, with respect to a fixed reference position, as the web is being unwound from the web roll, while the web roll is in its unwind position; slide-lay motor means for driving an output shaft; the motor means being mounted on the frame and being adapted to rotate its output shaft in a clockwise direction or counter-clockwise direction in response to the position of the side edge of the web, with respect to the reference position, as sensed by the side-lay sensing means; and means for connecting the output shaft of the motor means with the second end of the lift arm, when the lift arm is in its first position, and for causing the lift arm, and thus the web roll, to be moved in one direction or in the opposite direction, along the path of travel, in response to clockwise or counter-clockwise rotation of the output shaft of the motor means.

3. The improved lifting and loading machine of claim 2 wherein the slide-lay motor means are mounted on one end of a spring member and is disposed in the plane in which the first bearing means moves as the lift arm is moved along the path of travel; wherein the other end of the spring member is mounted on the frame; and which includes means for positioning the motor means so that the output shaft of the motor means is connected with the second end of the lift arm as the lift arm is moved to its first position.

4. The improved lifting and loading machine of claim 3 wherein the first bearing means contacts the positioning means as the lift arm is moved to its first position and deflects the motor means out of the plane in which the first bearing means moves against the bias of the spring member.

5. The improved lifting and loading machine of claim 1 wherein means for braking the rotation of the spindle are mounted on and carried by the first end of the lift arm.

6. An improved machine for lifting and loading a web roll, that has substantially parallel ends and a central core opening extending from one end to the other, from an unloaded position, where the web roll is disposed on a relatively fixed surface adjacent to the machine and is spaced from the machine in a first predetermined direction, to an unwind position, where the web from the web roll may be unwound by rotation of the web roll about the longitudinal axis of its central core opening, the improved lifting and loading machine comprising:

a frame for supporting the web roll in its unwind position;

a lift arm having a first end and a second end;

a spindle that is mounted on and cantilevered from the first end of the lift arm, with the longitudinal axis of the spindle extending in the first predetermined direction and toward the one end of the web roll when the web roll is in its unloaded position and that is adapted to be received within the central core opening of the web roll;

means for mounting the lift arm on the frame so that the first end of the lift arm may be selectively pivoted, with respect to its second end, about a first axis that is substantially parallel to the longitudinal axis of the spindle and so that the lift arm may be moved along a path of travel that is substantially parallel to the longitudinal axis of the spindle; and means for moving the lift arm between a first position where the web roll, mounted on the spindle, is in its unwind position and a second position where the spindle is inserted into the central core opening of the web roll when the web roll is in its unloaded position, the moving means including an idler roller assembly having an idler roller that is spaced vertically upwardly from the lift arm and that is mounted, at one end, for rotation about an axis of rotation substantially parallel to the longitudinal axis of the spindle; and a handle that is disposed adjacent the other end of the idler roller and that serves as a means to manually move the lift arm along the path of travel.

7. An improved machine for lifting and loading a web roll, that has substantially parallel ends and a central core opening extending from one end to the other, from an unloaded position, where the web roll is disposed on a relatively fixed surface adjacent to the machine and is spaced from the machine in a first predetermined direction, to an unwind position, where the web from the web roll may be unwound by rotation of the web roll about the longitudinal axis of its central core opening, the improved lifting and loading machine comprising:

a frame for supporting the web roll in its unwind position;

a lift arm having a first end and a second end;

a spindle that is mounted on and cantilevered from the first end of the lift arm, with the longitudinal axis of the spindle being substantially perpendicular to the plane of the lift arm and extending in the first predetermined direction and toward the one end of the web roll when the web roll is in its unloaded position and that is adapted to be received within the central core opening of the web roll;

means for mounting the lift arm on the frame so that the first end of the lift arm may be selectively pivoted, with respect to its second end, about a first axis that is substantially parallel to the longitudinal axis of the spindle and so that the lift arm may be moved along a path of travel that is substantially parallel to the longitudinal axis of the spindle, the mounting means including: a first rod mounted on the frame so that its longitudinal axis is co-axial with the first axis and is substantially parallel to the path of travel of the lift arm; first bearing means connected with the second end of the lift arm and engaging the first rod so that the second end of the lift arm may be moved along the first rod and so that the first end of the lift arm may be pivoted about the longitudinal axis of the first rod;

means for moving the lift arm between a first position where the web roll, mounted on the spindle, is in its unwind position and a second position where the spindle is inserted into the central core opening of the web roll when the web roll is in its unloaded position, the moving means including an idler roller assembly having an idler roller that is spaced vertically upwardly from the lift arm and that is mounted, at one end, for rotation about an axis of rotation substantially parallel to the longitudinal axis of the spindle; a handle that is disposed adjacent the other end of the idler roller and that serves as a means to manually move the lift arm along the path of travel; a power cylinder having its one end pivotably connected with the first end of the lift arm and having its other end pivotably connected with the frame; a second rod mounted on the frame so that the longitudinal axis of the second rod is substantially parallel to the path of travel; and second bearing means connected with the other end of the power cylinder and engaging the second rod so that the other end of the power cylinder may be moved along the longitudinal axis of the second rod and may be pivoted about the longitudinal axis of the second rod.

8. The improved lifting and loading machine of claim 7 wherein slide-lay motor means are mounted on one end of a spring member and are disposed in the plane in which the first bearing means moves as the lift arm is moved along the path of travel; wherein the other end of the spring member is mounted on the frame; and which includes means for positioning the motor means so that the output shaft of the motor means is connected with the second end of the lift arm as the lift arm is moved to its first position.

9. The improved lifting and loading machine of claim 8 wherein the first bearing means contacts the positioning means as the lift arm is moved to its first position and deflects the motor means out of the plane in which the first bearing means moves against the bias of the spring member; and wherein means for braking the rotation of the spindle are mounted on and carried by the first end of the lift arm.

10. The improved machine described in claim 1 wherein the web roll is in its unwind position when the spindle is received within the central core opening of the web roll and when the first end of the lift arm is in its upper position and the second end of the lift arm is in its rearward position.

* * * * *